US007351079B2

(12) United States Patent
Koga

(10) Patent No.: US 7,351,079 B2
(45) Date of Patent: Apr. 1, 2008

(54) CARD CONNECTOR

(75) Inventor: Shinichi Koga, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 25 days.

(21) Appl. No.: 11/606,475

(22) Filed: Nov. 30, 2006

(65) Prior Publication Data

US 2007/0128944 A1 Jun. 7, 2007

(30) Foreign Application Priority Data

Dec. 1, 2005 (JP) ..... 2005-347721

(51) Int. Cl.
*H01R 13/62* (2006.01)

(52) U.S. Cl. ..... 439/159; 439/141

(58) Field of Classification Search ..... 439/140, 439/141, 159, 160

See application file for complete search history.

(56) References Cited

U.S. PATENT DOCUMENTS 5,161,989 A * 11/1992 Okubo et al. ..... 439/159
5,368,493 A * 11/1994 O'Brien et al. ..... 439/160
5,451,168 A * 9/1995 Shuey ..... 439/159
5,667,396 A * 9/1997 Pan et al. ..... 439/160
6,027,351 A 2/2000 Hashimoto
6,042,404 A * 3/2000 Lai et al. ..... 439/159
6,139,338 A * 10/2000 Hirai et al. ..... 439/141
6,203,378 B1 * 3/2001 Shobara et al. ..... 439/638
6,478,592 B1 * 11/2002 Hu et al. ..... 439/159
6,508,402 B1 1/2003 Takada et al.
6,634,900 B2 * 10/2003 Hu et al. ..... 439/328
6,719,589 B2 4/2004 Nishio et al.

FOREIGN PATENT DOCUMENTS

JP 11-026084 1/1999
JP 2000-251024 9/2000
JP 2003-086296 3/2003
JP 2005-116240 4/2005

* cited by examiner

*Primary Examiner*—Thanh-Tam Le
(74) *Attorney, Agent, or Firm*—Jordan and Hamburg LLP

(57) ABSTRACT

Card connector having pull-out structure such that inserted card of any form can be smoothly pulled out. The card connector includes base frame; connector body; shutter member; rotary arm whose one end is in the central position of shutter member and whose other end is positioned at side frame of base frame; and eject structure that applies pushing force to the other end of rotary arm in the direction of connector body, when the card is pulled out, and provides force in the direction of pulling out card via shutter member in central position of the shutter member by the one end of the rotary arm.

4 Claims, 9 Drawing Sheets

1
1a
1b
1d
1e
2
2a
2b
3
3a
3b
3c
11b
14
30
31
31a
31b
10

1f
11a
11b
1c
B
1e
A
20

11a
11b
1e
20(40)
20a
20b
(40a)
1b
1f
1c

CARD CONNECTOR

CROSS-REFERENCE TO RELATED APPLICATIONS

This application is based upon and claims the benefit of priority from the prior Japanese Patent Application No. 2005-347721, filed on Dec. 1, 2005, the entire contents of which are incorporated herein by reference.

BACKGROUND OF THE INVENTION

1. Field of the Invention

The present invention relates to a card connector, and more particularly to a card connector having a specific card eject mechanism.

2. Description of the Related Art

Systems employing card-type memory devices and using them as external memory devices of electronic apparatuses have become widely spread in recent years. In order to connect such card-type memory devices to electronic apparatuses, connectors adapted thereto are required.

A large number of types and systems of connectors for card-type memory devices (referred to hereinbelow as card connectors) have been developed and introduced (for example, see Japanese Patent Application Laid-open No. 2000-251024, FIG. 1, page 3, right column).

The card connector described in Japanese Patent Application Laid-open No. 2000-251024, FIG. 1, page 3, right column has a configuration in which the side surface of the inserted card is suppressed and held by a suppression mechanism. However, with such connector, there is a risk of the inserted card being thrown out from the card holder under the effect of external impacts. For this reason, a shutter was provided for closing a card insertion port through which the card is inserted and the card was prevented from being thrown out by closing the shutter. Therefore, with the connector of this type, a shutter has to be provided separately from the connector. As a result, miniaturization is difficult, the number of component increases, and production cost rises significantly.

A connector in which the shutter was omitted to overcome the above-described drawbacks is also known (for example, see Japanese Patent Application Laid-open No. 2003-86296, FIG. 2, Par. No. 0015-0021).

The card connector described in Japanese Patent Application Laid-open No. 2003-86296, FIG. 2, Par. No. 0015-0021 has a configuration comprising a housing that forms an insertion section for inserting a card, contact terminals (contact pins) formed inside the housing in a condition of extending in the insertion direction so as to come into contact with the terminals of the card, and a lock mechanism for engaging with concave sections located on the side surfaces of the card and locking the card in a predetermined mounting position when the card is inserted into the insertion section and comes close to the mounting position.

With such connector structure, the card inserted into the mounting position of the housing can be prevented from falling out or being pulled out and the card can be locked on reaching the mounting position of the housing. Therefore, no load is applied to the card in the card insertion process, the insertion operation can be performed smoothly, the card can be prevented from being damaged by the lock mechanism, and it is not necessary to provide a special shutter mechanism.

Furthermore, when a card is removed from the card connector, the end section of the card is usually picked by fingers and pulled out, but when the contact is strong, the card cannot be easily pulled out. Moreover, the card is difficult to pull out because the card insertion port is narrow. Accordingly, a connector has been suggested that is provided integrally with an eject mechanism that facilitates the discharge of a card (for example, see Japanese Patent Application Laid-open No. 11-26084, FIG. 1, Par. No. 0019-0020, 30).

The card connector described in Japanese Patent Application Laid-open No. 11-26084, FIG. 1, Par. No. 0019-0020, 30 has a configuration comprising an eject mechanism having a cam member in one side section of a housing and comprising an elastic engagement member that engages with a linear side edge of a card discharged by the cam member in the other side section of the housing and regulates the movement of the card in the discharge direction. With such configuration, when the accommodated card is discharged by the eject mechanism having the cam member, the card can be prevented from falling down and the card can be easily removed by hand.

However, although some of the cards of various types, for example, compact flash (CF) (registered trade name) cards, smart media cards, memory sticks, and PC cards are regulated by standards, a standard that has unified all the cards has not yet been established. For this reason, the cards of various types differ in dimensions and shapes and accordingly the card connectors have structures suitable for respective cards.

As a result, a user of an electronic apparatus sometimes erroneously inserts a small card into a large card insertion port. If an incompatible card is inserted erroneously into an insertion port, the contact pins of the connector can be deformed or broken. Furthermore, even if the card is of the same size as the insertion port, the card is sometimes inserted upside down or back to front. Such reverse insertion also can cause a similar damage. Furthermore, dust or dirt easily adheres to the contact pins of the connector, thereby causing poor contact.

Furthermore, in the connector described in Japanese Patent Application Laid-open No. 2000-251024, FIG. 1, page 3, right column, the inserted card cannot be held reliably, a shutter has to be provided in the card insertion port to prevent the card from being thrown out, and the shutter has to be provided separately from the connector.

The connector described in Japanese Patent Application Laid-open No. 2003-86296, FIG. 2, Par. No. 0015-0021 has no shutter, is equipped with a lock mechanism and prevents the card inserted into the mounting position of the housing from falling out or being pulled out, but it does not resolve all the aforementioned problems encountered when the card connector is disposed in an electronic apparatus. Furthermore, those problems are also not resolved with the connector described in Japanese Patent Application Laid-open No. 11-26084, FIG. 1, Par. No. 0019-0020, 30.

In order to resolve the aforementioned problems, the applicant suggested an invention the objects of which were to provide a card connector comprising a mechanism capable of preventing the contact pins from being bent or damaged even when a card of different size is inserted by mistake and to provide a card connector equipped with an eject mechanism for easily discharging the inserted card (Japanese Patent Application Laid-open No. 2005-116240).

The structure of the card connector (connector of the prior application) that has been previously suggested by the applicant and is described in Japanese Patent Application Laid-open No. 2005-116240 will be described in general features with reference to FIG. 1.

FIG. 1 shows a card connector equipped with an eject mechanism. FIG. 1(A) is a plan view, FIG. 1(B) is front view, and FIG. 1(C) is a left side view.

The card connector has a plurality of contact pins 21*b*. Referring to FIG. 1, if a CF (Compact Flash (registered trade name)) card is inserted into the connector, then the terminals (contacts) of the CF (Compact Flash (registered trade name)) card and a plurality of corresponding contact pins 21*b* assumes a state in which they are electrically connected by a physical contact thereof.

As shown in FIG. 1, the eject mechanism serving to facilitate the ejection of the inserted card has a rotary arm 22 mounted on one surface of a frame base 21 and a push bar 23 linked to the rotary arm 22. The operation of the push bar 23 releases the physical contact of the card contacts and contact pins 21*b* of the card. As a result, the card can be taken out.

The frame base 21 is from a rectangular metal sheet large enough to cover the upper surface of the connector, both opposing side ends thereof are bent, and two side frames are formed by the bent pieces.

The push bar 23 is fixed by a plurality of locking pieces so that the push bar can slide in the lengthwise direction of the side section frame.

The push bar 23 has joining sections 23*a*, 23*b* at one end thereof and is joined by the joining sections 23*a*, 23*b*. An eject knob 24 that protrudes outwardly is provided at the other end of the push bar 23, and the eject button 24 is so configured that when it is pushed from the outside, the rotary arm 22 is actuated via the push bar 23.

The rotary arm 22 is from a plate piece of an almost bow-like shape and has a suspension piece 22*c* bent at an almost right angle to an end section 22*b* located at the opposite side from one end 22*a*. The suspension piece 22*c* protrudes from an opening 21*a* of the frame base 21, is positioned at the end section on the end side of a card between a shutter member 24 and an end side of the inserted card, and functions as a push section with respect to the card (see FIG. 1(B)).

Before a card is inserted, the shutter member 24 protects the distal end sections of the contact pins 21*b* with through orifices 24*a*, and as the card is inserted, the shutter member moves together with the card in the depthwise direction and the distal end sections of the contact pins 21*b* are exposed from the through orifices 24*a*; the shutter member will be described hereinbelow in greater detail. As a result, a physical contact can be created between the card contacts and contact pins 21*b* of the card connector.

The rotary arm 22 is pivotally supported by a pivot pin 22*d* in an almost central position in the widthwise direction of the frame base 21 in a position slightly closer to the suspension piece 22*c* from the center of the rotary arm. Due to such pivotal support, if the eject knob 24 is pushed, the suspension piece 22*c* comes into contact with the end section of the end side of the inserted card via the push bar 23 due to the lever action of the rotary arm 22, and a push-down force that is larger than the force acting on the eject knob 24 in the direction shown by a solid arrow will be applied to the suspension piece 22*c* in the direction opposite that shown by the solid arrow. As a result, the card can be ejected.

In the eject mechanism of the heretofore suggested card connector, the rotary arm 22 has been pivotally supported by the pivot pin 22*d* in almost the central position in the widthwise direction of the frame base 21.

Therefore, the position of the suspension piece 22*c* is shifted from the center in the widthwise direction of the frame base 21. As a result, the position of abutment against the card end side is inevitably shifted from the center of the card.

On the other hand, cards of a variety of forms have recently been developed and put to use. An example of such card form is shown in FIG. 2. A card 40 shown in FIG. 2 has a form of a CF card and is a conversion card for connecting a small card such as a smaller SD card to a CF card connector.

The conversion card 40 has a contact 40*a* for connection to the contact pins 21*b* of the CF card connector and an internal contact pin 40*b* for connection to a contact 41*a* of a small card 41. The contact 40*a* and the internal contact pin 40*b* are electrically connected inside the card 40.

Furthermore, a space 40*c* is provided for introducing the small card 41 instead of the internal electric circuit of the CF card itself. If the small card 41 is inserted into the space 40*c*, the contact 41*a* of the small card 41 and the internal contact pin 40*b* are electrically connected by a physical contact thereof.

As a result, the small card 41 can be connected to the CF card connector by connecting the contact 40*a* of the CF card 40 having the small card 41 inserted therein to the contact pins 21*b* of the CF card connector.

SUMMARY OF THE INVENTION

Here, the CF card connector has a structure such that both sides of the CF card are guided by two side frames and the connection of the CF card contacts and the contact pins of the connectors is facilitated.

When the CF card is pulled out from the CF card connector, a push-out force is provided to the end section of the end side of the card by the suspension piece 22*c*, as shown in FIG. 1, and both sides of the CF card are guided by the two side frames. As a result, the CF card can be pulled out from the CF card connector.

However, with the form of the conversion card 40 such as shown in FIG. 2, two sides 40*d* of the conversion card 40 are deformed to form a space 40*c* for inserting a small card 41. On the other hand, the position of the suspension piece 22*c* is not in the center, as shown in FIG. 1. Therefore, the push-out force created by the suspension piece 22*c* is applied to a position shifted from the center of the end side of the card.

The problem arising from such mutual arrangement is that when the conversion card 40 is pulled out along the two side frames of the CF card connector, the conversion card 40 is tilted and the two sides 40*d* of the conversion card 40 cannot be smoothly guided by the two side frames of the CF card connector.

Accordingly, it is an object of the present invention to resolve the above-described problems and to provide a card connector having a pull-out structure such that an inserted card of any form can be smoothly pulled out.

In accordance with the first aspect of the present invention that attains the aforementioned object, there is provided a card connector having: a base frame having side frames formed by bending at both sides thereof; a connector body provided at an end side of the base frame opposite that where a card is inserted and serving to arrange and fix a plurality of contact pins in a row; a shutter member that has through orifices corresponding to the plurality of contact pins that are arranged in a row and fixed by the connector body and can move in a state in which the contact pins are inserted into the through orifices; and a rotary arm whose one end is in the central position of the shutter member and whose other end is positioned at the side frame of the base frame, wherein the card connector has an eject structure in which when the card is pulled out, the eject structure applies a pushing force to the other end of the rotary arm in the direction of the connector body, and provides a force in the direction of pulling out the card via the shutter member in the central position of the shutter member by the one end of the rotary arm.

As a specific feature of the present invention that attains the aforementioned object, the card connector of the above-described first aspect can be configured so that the rotary arm is pivotally supported on the surface side of the base frame opposite the surface side where a card is inserted, a hook section is formed at the shutter member, an opening is provided in substantially the center of the base frame in the widthwise direction, and the one end of the rotary arm is engaged with the hook section of the shutter member that exits from the opening.

As a specific feature of the present invention that attains the aforementioned object, the card connector of the above-described aspects can further have a slidable push bar provided at the side frame, wherein a distal end section of the push bar engages with the other end of the rotary arm, when the card is pulled in a state where the connectors of the inserted card and the contact pins are connected, a pushing pressure is applied by the push bar to the one end of the rotary arm, a pushing pressure in the opposite direction is applied to the other end of the rotary arm, and a force in the pulling direction is applied to the card via the shutter member.

Furthermore, as a specific feature of the present invention that attains the aforementioned object, the card connector of any of the above-described aspects may have a shutter lock mechanism that locks the movement of the shutter member before the card is inserted, releases the lock in response to the insertion of the compatible card, and allows the connection of the card contacts with the contact pins, wherein the shutter lock mechanism is formed by a segment lead of at least one side frame of the two side frames of the base frame.

In accordance with the present invention, a pull-out force is provided almost in the central section of the shutter member by a rotary arm serving as an eject mechanism. Therefore, the card is not tilted in the card pull-out process even when a card with deformed sides, such as a conversion card, is used. As a result, the card can be smoothly pulled out along the two side frames formed on both sides of the frame base.

BRIEF DESCRIPTION OF THE DRAWINGS

FIG. 1 shows a card connector equipped with an eject mechanism.

DESCRIPTION OF THE PREFERRED EMBODIMENTS

Embodiments of the present invention will be described hereinbelow with reference to the appended drawings. The embodiments merely illustrate the present invention and place no limitation on the application of the present invention.

Figures 3A, 3B, 3C, 3D:
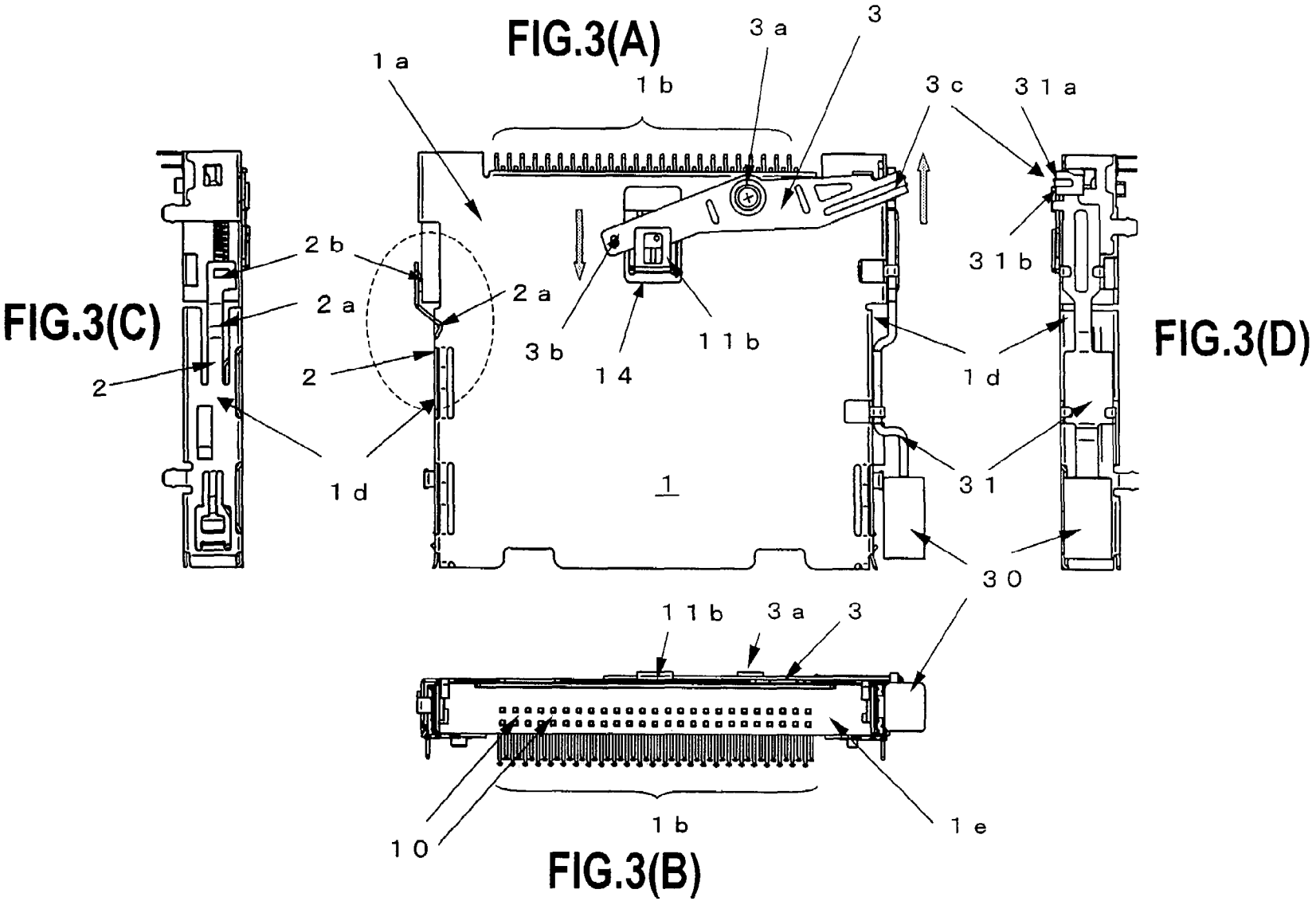
FIGS. 3(A), 3(B), 3(C) and 3(D) show an embodiment of the card connector in accordance with the present invention.

FIG. 3 illustrates an embodiment of the card connector in accordance with the present invention. FIG. 3(A) is a plan view, FIG. 3(B) is a front view, and FIGS. 3(C), (D) are left and right side views.

Figure 4B:
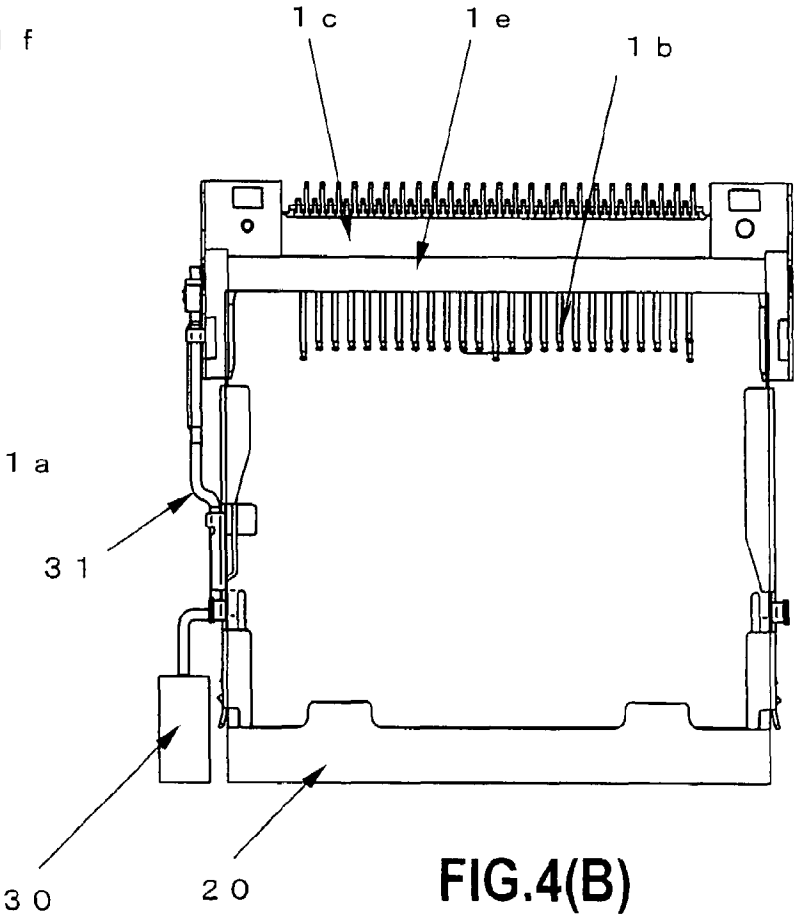
FIGS. 4(A) and 4(B) show a surface opposite that shown in FIG. 3.
Figure 4A:
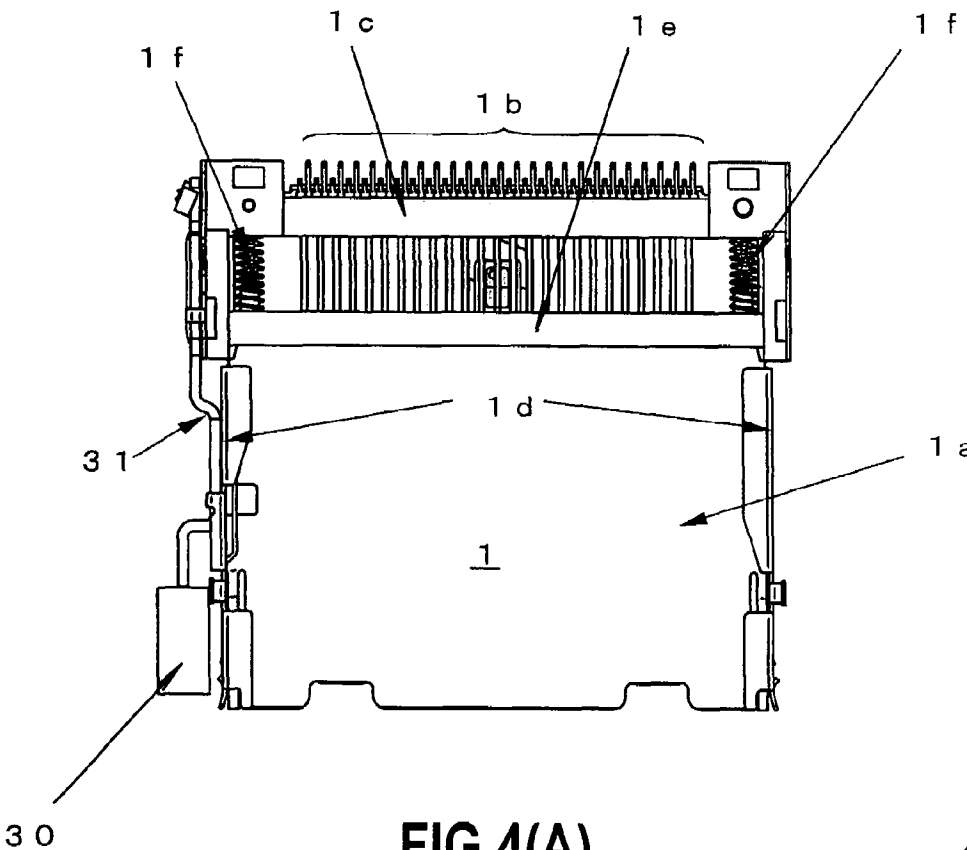

FIG. 4 is a view showing the side opposite that shown in FIG. 3. FIG. 4(A) shows a state in which a card has not been inserted. By contrast, FIG. 4(B) shows a state after the card has been inserted.

A card connector 1 in accordance with the present invention has a base frame 1*a* in the form of a metal plate. As shown in FIG. 4, two side frames 1*d* are formed by U-shape bending at both sides of the base frame 1*a*. The card to be inserted can be held by fingers by the U-shaped bent sections of the two side frames 1*d*.

The card connector has a connector body 1*c* formed from an insulating block such as a resin block for arranging in a row and fixing a plurality of contact pins 1*b* on the side of the base frame 1*a* opposite that where the card is to be inserted. Furthermore, a shutter member 1*e* is provided for covering the distal end sections of the plurality of contact pins 1*b* that are arranged in a row and fixed by the connector body 1*c* and protecting them from the outside.

As shown in FIG. 4(A), before a card 20 is inserted, the distal end sections of the contact pins 1*b* are covered and protected by the shutter member 1*e*.

As clearly shown in FIG. 3(B), the shutter member 1*e* has through orifices 10 corresponding to the plurality of contact pins 1*b*. When the card 20 is not inserted, as shown in FIG. 4(A), the shutter member 1*e* is positioned at the distal end sections of the contact pins 1*b* by an elastic pressure of a coil spring 1*f* inserted between the connector body 1*c* and shutter member 1*e*. In this state, the distal end sections of the contact pins 1*b* are protected.

When the card 20 is inserted, as shown in FIG. 4(B), the shutter member 1*e* is pushed toward the connector body 1*c* by the end section of the card 20 against the elastic pressure of the coil spring 1*f*. As a result, the distal end sections of the contact pins 1*b* are pushed into the through orifices 10 of the shutter member 1*e* and inserted into the contacts on the side of the card 20, thereby enabling the electric connection of the contact pins 1*b* and contacts of the card 20.

To facilitate the understanding, FIG. 4(B) shows transparently a state in which the distal end sections of the contact pins 1*b* are inserted and connected to the contacts on the card.

To facilitate further the understanding of the present invention, this configuration will be further explained with reference to FIG. 5 and FIG. 6 that show the state where the base frame 1*a* and two side frames 1*d* were removed.

Figures 5A, 5B:
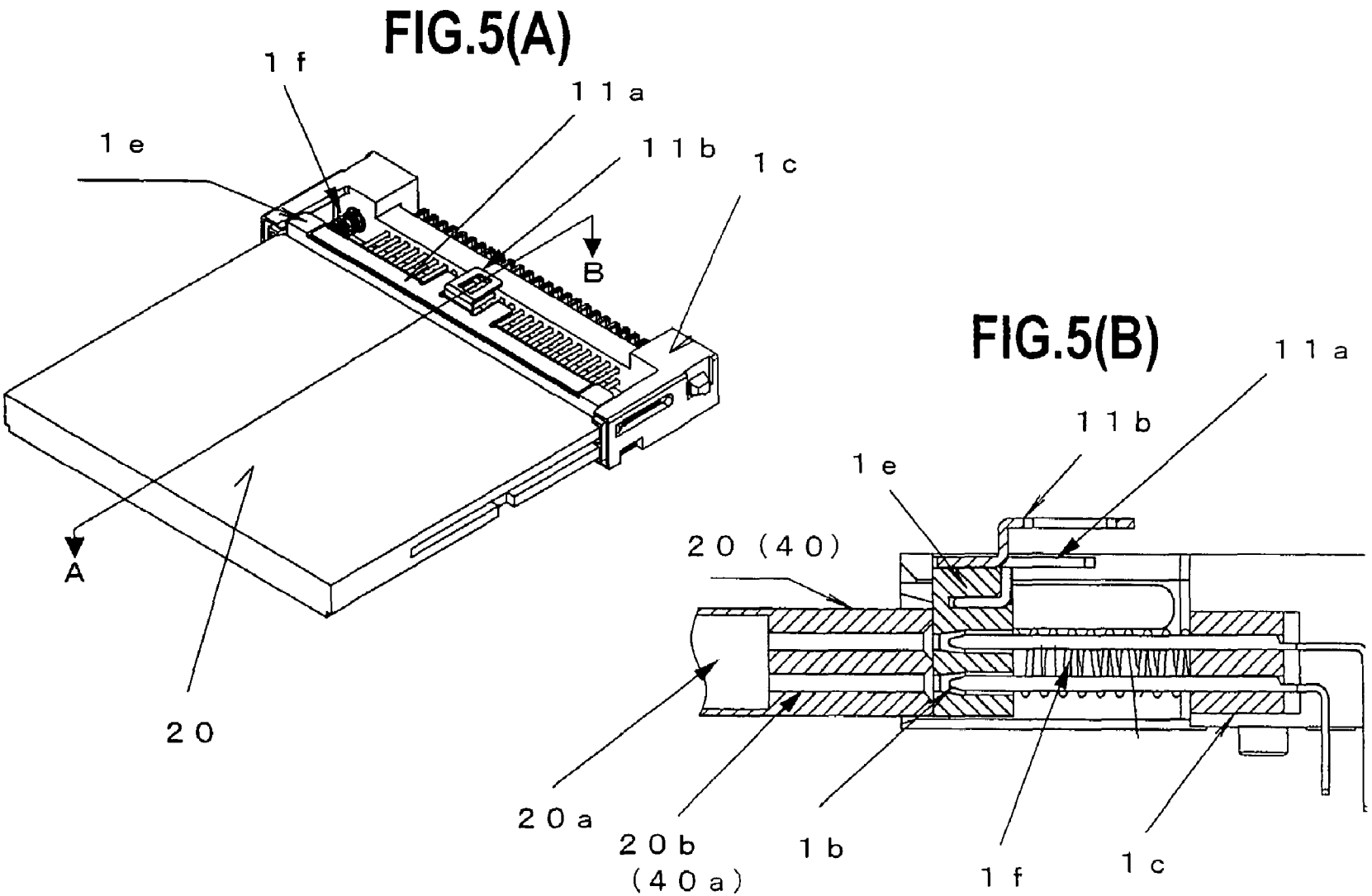
FIGS. 5(A) and 5(B) show a state before the card 20 is connected to the contact pins 1*b* that is illustrated by a state in which the base frame 1*a* and both side frames 1*d* are removed.

FIG. 5 shows a state before the card 20 is connected to the contact pins 1*b*. FIG. 5(A) is a perspective view of the state after the base frame 1*a* and two side frames 1*d* have been removed. FIG. 5(B) is a cross-sectional view of the portion of the connector body 1*c* along the A-B line.

When the card 20 is not inserted, the shutter member 1*e* is pushed out by the coil spring 1*f* located between the shutter member and the connector body 1*c* and assumes a state in which the distal end sections of the contact pins 1*b* that have been arranged in a row and fixed by the connector body 1*c* are accommodated in the through orifices 10. As a result, the distal end sections of the contact pins 1*b* are protected.

Figure 2:
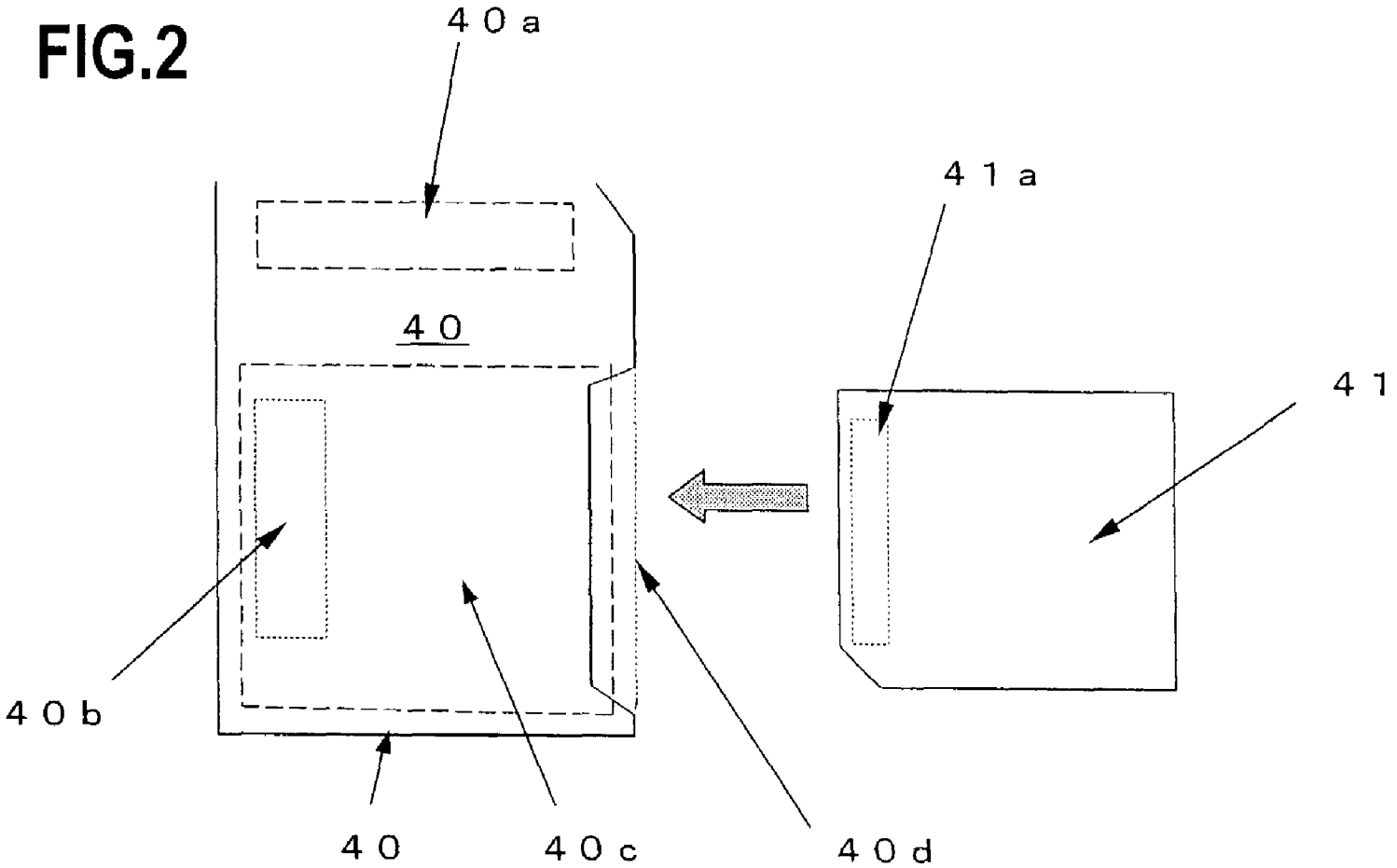
FIG.2 RELATED ART
FIG. 2 shows a card form example.

The card 20 has a circuit component accommodation section 20*a* and female-type contacts 20*b* linked thereto. When the card 20 is a modified card, as shown in FIG. 2, it has contacts 40 similar to the female-type contacts 20*b* for connection to internal contact pins 40*b*.

Here, returning to FIG. 3 and FIG. 4, a lock mechanism of the shutter member 1*e* will be considered. Thus, as shown in FIG. 5(B), when the card 20 (or conversion card 40) is not inserted, the shutter member 1*e* assumes a state in which the distal end sections of the contact pins 1*b* are accommodated in the through orifices 10 by the coil spring 1*f*.

In the case where the distal end sections of the contact pins 1*b* are easily exposed if a pushing pressure is applied to the shutter member 1*e* against the elastic pressure of the coil spring 1*f*, the protection of contact pins 1*b* cannot be expected.

For this reason, in the invention suggested in the prior application filed by the applicant (Japanese Patent Application Laid-open No. 2005-116240), a structure was used in which a pair of side frames were detachably mounted on both side walls of the connector body, and a lock mechanism was provided on this pair of side frames. Furthermore, the lock mechanism was configured of a lock spring member that was deformed when the card was inserted, thereby causing disengagement from the shutter member, and, conversely, the state of engagement with the shutter member was restored when the card was removed.

With such structure, as has already been explained hereinabove, the width of the connector body was unavoidably increased because a pair of side frames was provided on both side walls of the connector body. Furthermore, since a lock spring member was provided on the side frames, the structure unavoidably became complex.

A specific feature of the configuration shown in FIGS. 3, 4 that illustrates an application example of the present invention is that the lock mechanism is configured of a segment lead 2 formed in the two side frames 1*d* of the base frame 1*a*, as shown in FIG. 3.

Thus, a segment lead 2 is formed in at least one of the two side frames 1*d*. In the example shown in FIG. 3, the segment lead is formed in the left side frame 1*d*.

The segment lead 2 can be formed at the same time as the side frame 1*d* is press formed. Therefore, by linking one end of the segment lead 2 to the side frame 1*d* and leaving the other end as a free end, elasticity is provided due to the rigidity of the side frame 1*d* itself.

The segment lead 2, as shown by a cross-sectional view thereof in FIG. 7, is molded by bending so that it has respective protrusions 2*a*, 2*b* in the central section and distal end section.

Figure 7B:
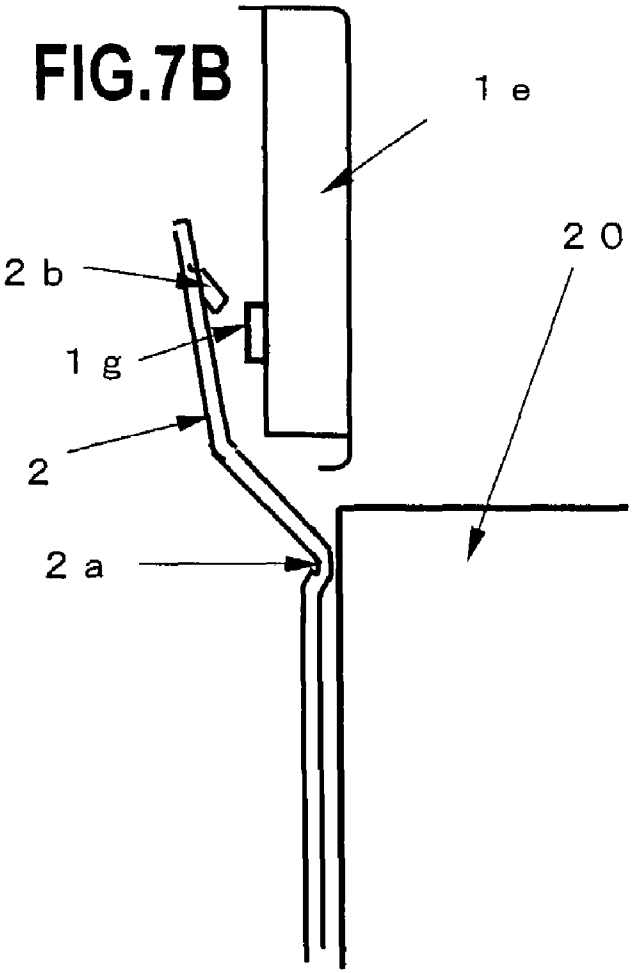
FIGS. 7A and 7B are cross-sectional views of the segment lead 2.
Figure 7A:
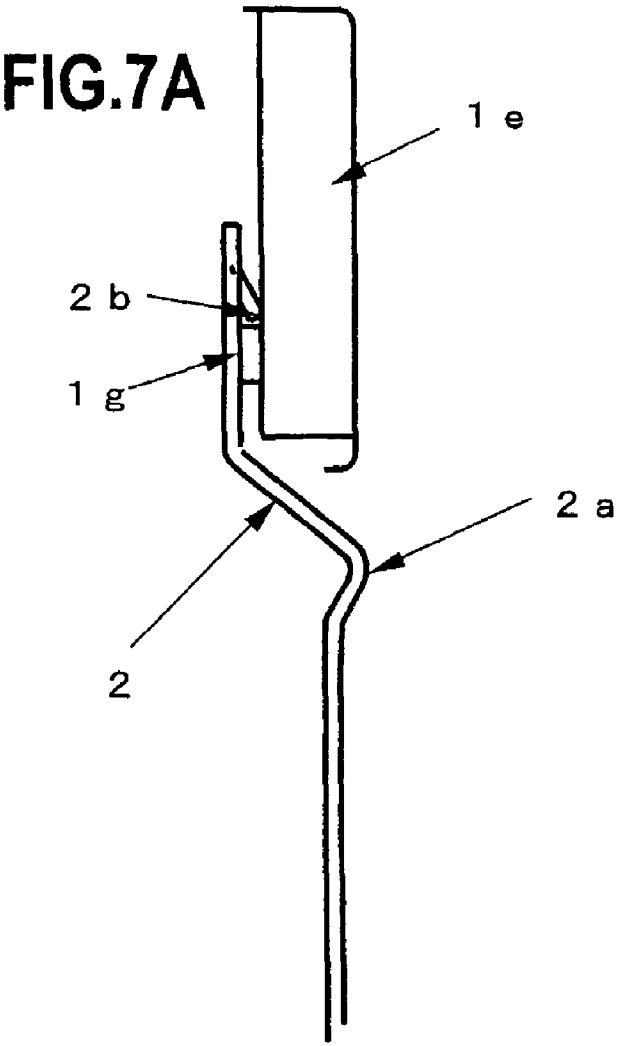

FIG. 7A shows a state in which the card 20 is not inserted. FIG. 7B shows a state in which the card 20 is inserted into the card connector and pulled out therefrom.

Referring to FIG. 7A, as has already been explained, when the card 20 is not inserted, the shutter member 1*e* is in a position of protecting the distal end sections of the contact pins 1*b* due to the action of the coil spring 1*f* (see FIG. 5(B)).

At this time, as shown in FIG. 7A, since the elasticity of the segment lead 2 creates a returning force acting in the direction inward of the side frame 1*d* (rightward in FIG. 7A), the protrusion 2*b* at the distal end section of the segment lead 2 and a hook section 1*g* formed in the side section of the shutter member 1*e* are engaged.

As a result, the state in which the shutter member 1*e* protects the distal end sections of the contact pins 1*b* (FIG. 5(B)) is maintained, even if a pushing pressure is applied to the shutter member 1*e*.

On the other hand, if a state is assumed in which the card 20 is inserted, as shown in FIG. 7B, then the side section at the distal end of the card 20 will apply an outward push-out force to the protrusion 2*a* located in the intermediate section of the segment lead 2.

As a result, the segment lead 2 will be deformed and the engagement of the protrusion 2*b* at the distal end section and the hook section 1*g* of the shutter member 1*e* will be released. Then, the card 20 can be further inserted into the card connector 1.

Figures 6A, 6B:
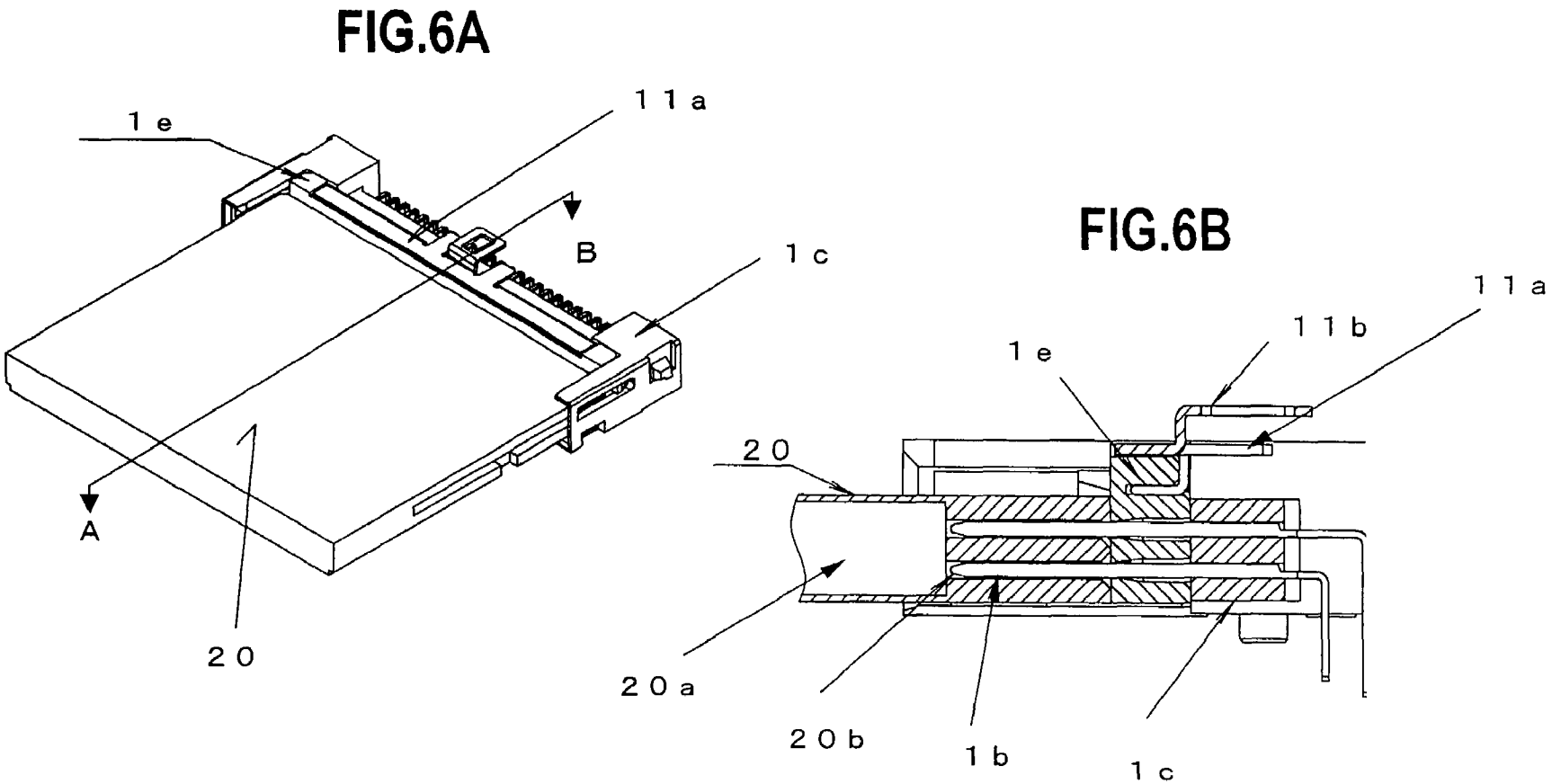
FIGS. 6(A) and 6(B) show a state after the card 20 has been connected to the contact pins 1*b* that is illustrated by a state in which the base frame 1*a* and both side frames 1*d* are removed.

FIG. 6 shows a state in which the card 20 (or conversion card 40) is completely inserted into the card connector 1, and the card 20 is connected to the contact pins 1*b*. FIG. 6A is a perspective view illustrating the state in which the base frame 1*a* and both side frames 1*d* were removed, and FIG. 6B is a cross-sectional view of the portion of the connector body 1*c* along the A-B line.

Due to the insertion of the card 20, the shutter member 1*e* is pushed back toward the connector body 1*c* against the elastic force of the coil spring 1*f*. As a result, the distal end sections of the contact pins 1*b* are exposed from the through orifices 10 of the shutter member 1*e* and inserted into the female-type contacts 20*b* of the card 20, thereby producing a state of electric connection to the circuits inside the circuit component accommodation section 20*a* of the card 20.

Referring to FIG. 7B, when the contacts of the card 20 are pulled out from the card connector, the contact of the side section of the card 20 and the protrusion 2*a* of the intermediate section of the segment lead 2 is released and the segment lead is returned by the elasticity thereof into the state shown in FIG. 7A. At this time, the shutter member 1*e* is pushed out by the coil spring if, whereby the hook section 1*g* at the side section of the shutter member 1*e* and the protrusion 2*b* of the distal end section of the segment lead 2 are re-engaged and the state shown in FIG. 7A is maintained.

Here, when a card 20 (conversion card 40) is pulled out from the card connector in a state where the distal end sections of the contact pins 1*b* and the female-shaped contacts 20*b* (or 40*a*) of the card 20 (or conversion card 40) are connected, an eject mechanism is necessary for providing a pull-out force against a physical contact pressure created by the elasticity of the contacts 20*b* (40*a*) and contact pins 1*b*.

Figures 1A, 1B, 1C:
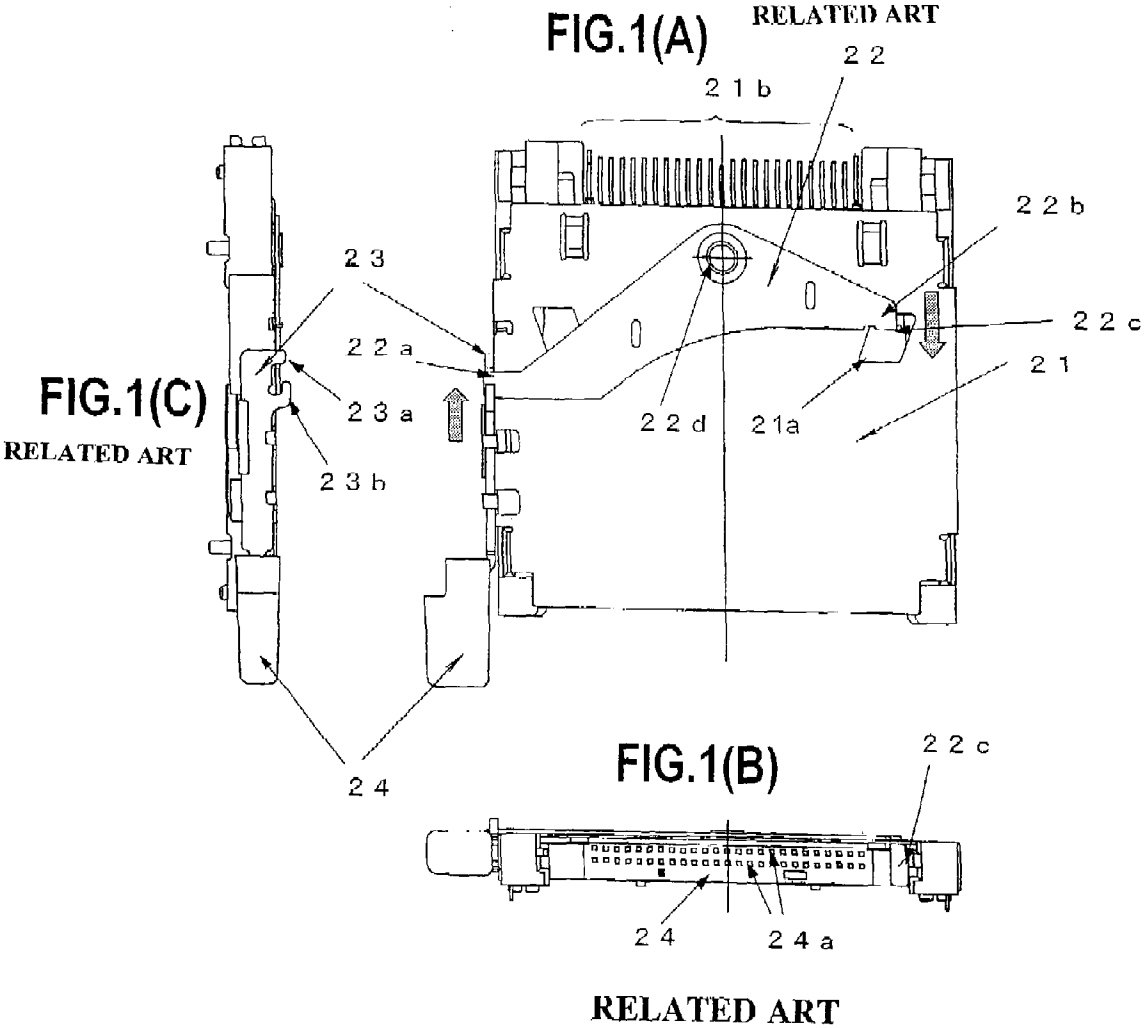
FIG.1(A) RELATED ART
FIG.1(B) RELATED ART
FIG.1(C) RELATED ART
FIG. 1(A) is a plan view.
FIG. 1(B) is a front view.
FIG. 1(C) is a left side view.

The present invention relates to the problem of the eject mechanism of the invention of the prior application explained with reference to FIG. 1. The eject mechanism in accordance with the present invention will be explained hereinbelow in an embodiment including the above-described lock mechanism of the shutter member 1*e*.

Returning to FIG. 3, a rotary arm 3 that can rotate about a support shaft 3*a* is provided on the surface of the base frame 1*a* on the side opposite that where the card 20 (conversion card 40) is held.

On the other hand, as shown in FIG. 5, a hook section 11*b* is provided in the central section of a metal sheet 11*a* integrally attached to the upper surface of a resin block constituting the shutter member 1*e*.

This hook section 11*b* can be of a variety of forms corresponding to the configuration of the shutter member 1*e*.

Figures 8A, 8B:
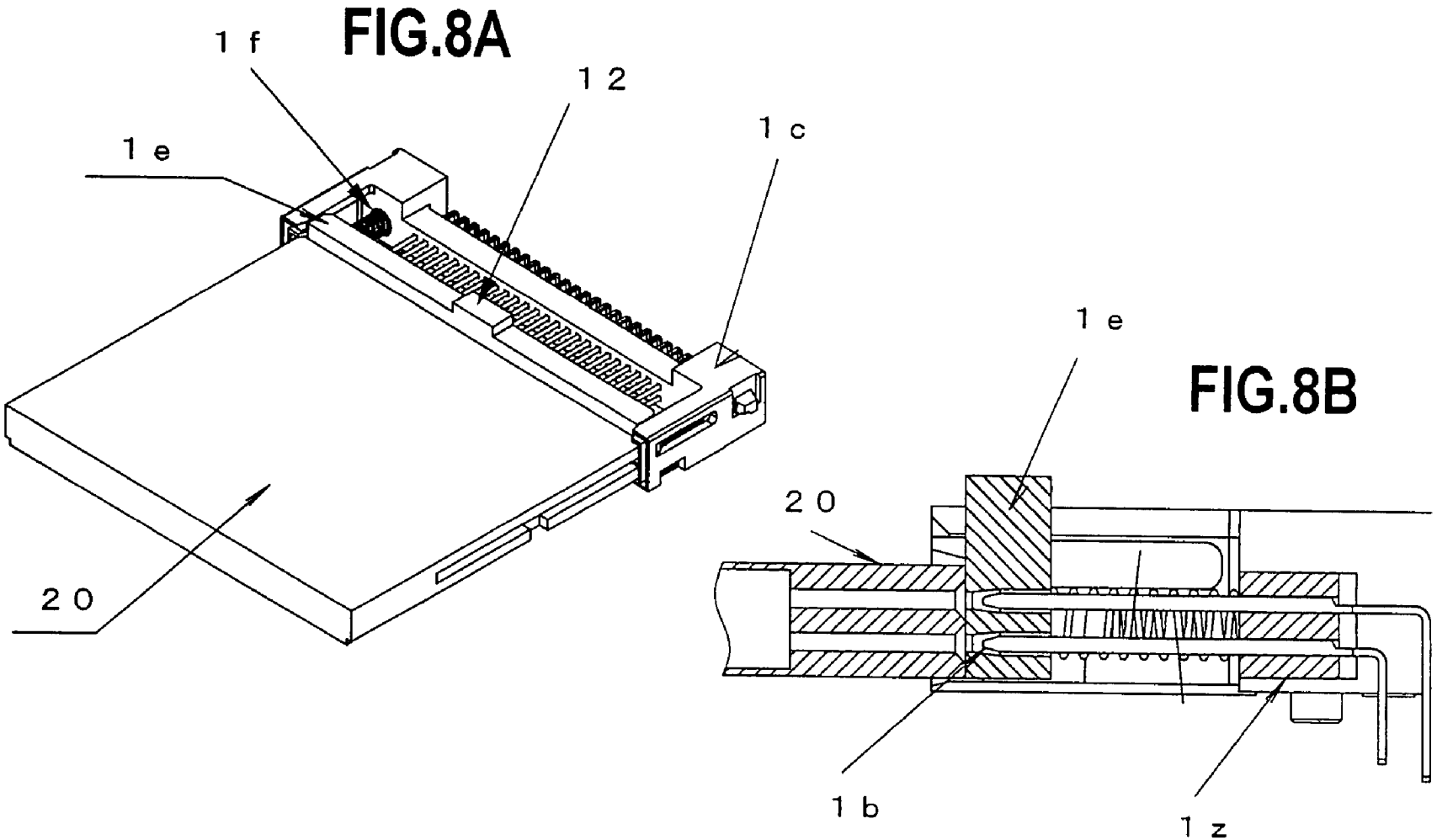
FIGS. 8A and 8B show another configuration example of the shutter member 1*e*.

FIG. 8 shows an example of configuration in which a protrusion 12 is formed in the central section of the resin block constituting the shutter member 1*e*, whereby the function identical to that of the hook section 11*b* is demonstrated.

Figures 9A, 9B:
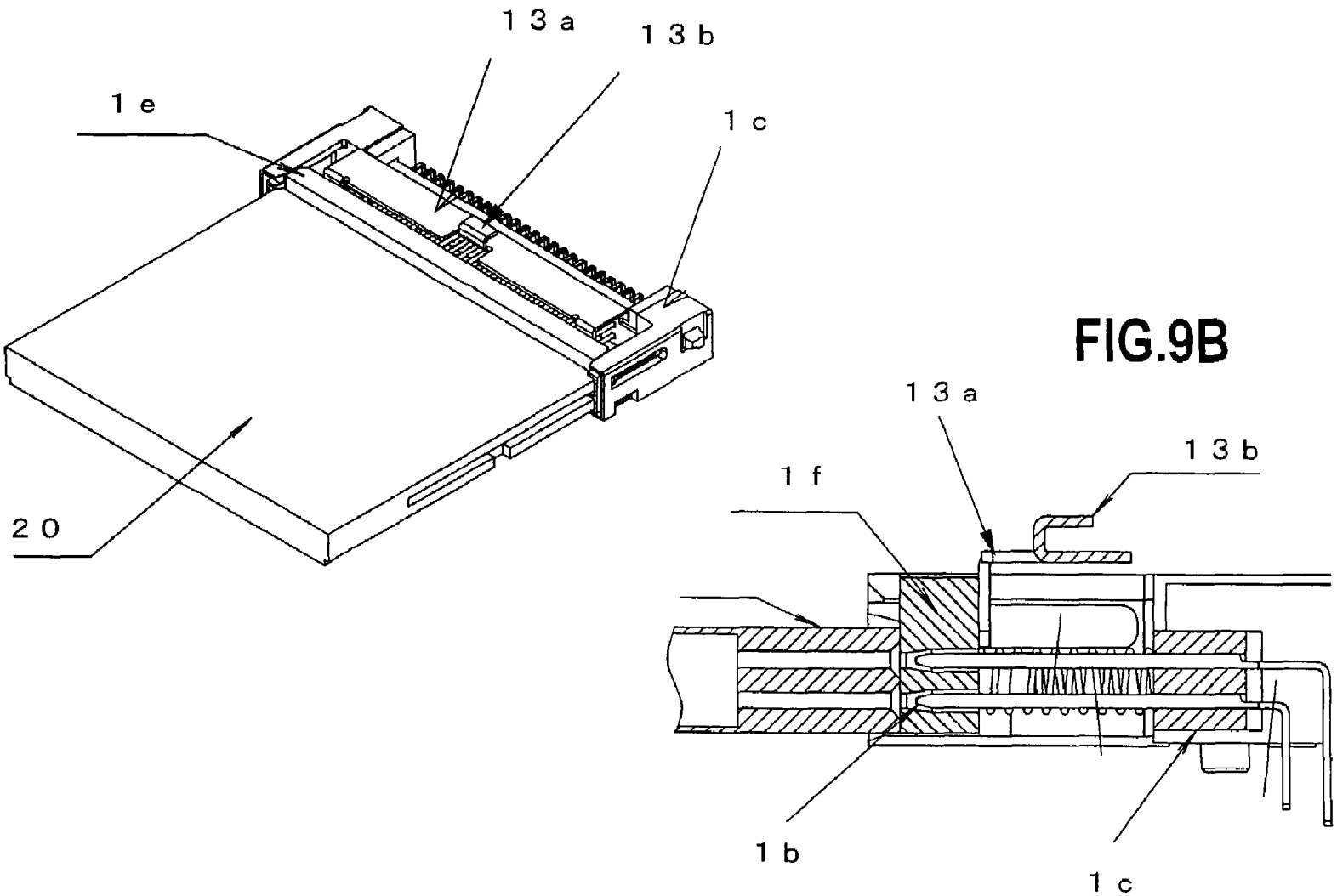
FIGS. 9A and 9B show yet another configuration example of the shutter member 1*e*.

Furthermore, FIG. 9 shows a configuration in which, instead of attaching the metal sheet 11*a* integrally to the upper surface of the resin block of the shutter member 1*e* and forming the hook section 11*b* as shown in FIG. 5, a metal sheet 13*a* is attached to the side surface of the resin block and a hook section 13*b* is formed by the bent section in the central section thereof.

In all the embodiments, the hook section is formed almost in the central section of the shutter member 1*e*.

Returning to FIG. 3, the hook section 11*b* (the protrusion 12 in the embodiment shown in FIG. 8, and the hook section 13*b* in the embodiment shown in FIG. 9) formed at the shutter member 1*e* is disposed so as to appear on the opposite surface of the base frame 1*a* through an opening 14 formed in the central section in the widthwise direction of the base frame 1*a*.

Therefore, one end side 3*b* of the rotary arm 3 is engaged with the hook section 11*b*. Furthermore, the other end side 3*c* of the rotary arm 3 is engaged with lock sections 31*a*, 31*b* of the distal end section of the push bar 31 held by a plurality of locking hooks so as to enable the sliding movement to one of the two side frames 1*d*. Furthermore, an eject knob 30 is provided at the distal end of the push bar 31.

Where the push bar 31 is pushed in the direction of the contact pins 1*b* shown in FIG. 2 by the eject knob 30 in a state in which the card 20 (or conversion card 40) is inserted into the card connector 1, due to the engagement of the push bar 31 and rotary arm 3, the other end side 3*c* of the rotary arm 3 is pushed up in the direction shown by an upward solid arrow about the support shaft 3*a* as a center. As a result, the end side 3*b* of the rotary arm 3 is pushed down in the direction of the downward solid arrow about the support shaft 3*a* as a center.

Since the one end side 3*b* of the rotary arm 3 is engaged with the hook section 11*b* located in the central section of the metal plate 11*a* that is integrally attached to the resin block of the shutter member 1*e*, a push-out force is easily provided in the direction opposite the connector body 1*c* by a lever action in the central section of the shutter member 1*e*.

As a result, the connection of the contacts 20*b* (40*a*) of the card 20 (or conversion card 40) and the distal end sections of the contact pins 1*b* is disrupted and the card 20 (or conversion card 40)can be easily pulled out by fingers.

Because the ejector mechanism in accordance with the present invention produces a pull-out force almost in the central section of the shutter member 1*e* by the rotary arm 3, even the card with modified sides, such as the conversion card 40, can be smoothly pulled out.

The foregoing description of the embodiments is not intended to limit the invention to the particular details of the examples illustrated. Any suitable modification and equivalents may be resorted to the scope of the invention. All features and advantages of the invention which fall within the scope of the invention are covered by the appended claims.

What is claimed is:

1. A card connector comprising:

a base frame having side frames formed by bending at both sides thereof;

a connector body provided at an end side of the base frame opposite the side where a card is inserted and serving to arrange and fix a plurality of contact pins in a row;

a shutter member that has through orifices corresponding to the plurality of contact pins that are arranged in a row and fixed by the connector body and can move in a state in which the contact pins are inserted into the through orifices;

a rotary arm whose one end is in a central position of the shutter member and whose other end is positioned at one of the side frames of the base frame; and an eject structure that applies a pushing force to the other end of the rotary arm in a direction toward the connector body, when the card is pulled out, and provides a force in a direction of pulling out the card via the shutter member in the central position of the shutter member by the one end of the rotary arm, wherein the rotary arm is pivotally supported on a surface side of the base frame opposite a surface side where the card is inserted, and a hook section is formed at the shutter member, an opening is provided substantially in a center of the base frame in a widthwise direction, and the one end of the rotary arm is engaged with the hook section of the shutter member that exits from the opening.

2. The card connector according to claim 1, further comprising a slidable push bar provided at the side frame, wherein a distal end section of the push bar engages with the other end of the rotary arm, when the card is pulled out in a state where contacts of the card and the contact pins are connected, a pushing pressure is applied by the push bar to the one end of the rotary arm, a pushing pressure in the opposite direction is applied to the other end of the rotary arm, and a force in the pulling direction is applied to the card via the shutter member.

3. The card connector according to claim 1, further comprising a shutter lock mechanism that is formed by a segment lead of at least one side frame of the two side frames of the base frame, and locks a movement of the shutter member before the card is inserted, releases the lock in response to the insertion of the card, and allows the connection of the card contacts with the contact pins, wherein the card is a compatible card.

4. The card connector according to claim 2, further comprising a shutter lock mechanism that is formed by a segment lead of at least one side frame of the two side frames of the base frame, and locks a movement of the shutter member before the card is inserted, releases the lock in response to the insertion of the card, and allows the connection of the card contacts with the contact pins, wherein the card is a compatible card.

* * * * *